US007762840B2

(12) United States Patent
Hamner et al.

(10) Patent No.: US 7,762,840 B2
(45) Date of Patent: Jul. 27, 2010

(54) CONNECTOR SYSTEM HAVING AN ELEVATED UPPER ELECTRICAL CONNECTOR

(75) Inventors: Richard Elof Hamner, Hummelstown, PA (US); Tyler John Miller, Mechanicsburg, PA (US); Justin Shane McClellan, Camp Hill, PA (US); Jason M'Cheyne Reisinger, Carlisle, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/250,345

(22) Filed: Oct. 13, 2008

(65) Prior Publication Data

US 2010/0093208 A1 Apr. 15, 2010

(51) Int. Cl.
*H01R 13/60* (2006.01)
*H01R 13/66* (2006.01)

(52) U.S. Cl. ..... 439/541.5; 439/607.23; 439/607.55

(58) Field of Classification Search ..... 439/541.5, 439/607.23, 607.24, 607.25, 607.27, 607.35, 439/607.53, 607.55
See application file for complete search history.

(56) References Cited

U.S. PATENT DOCUMENTS 6,162,089 A * 12/2000 Costello et al. ..... 439/541.5
6,688,914 B1 * 2/2004 Espenshade et al. ..... 439/541.5
6,755,685 B1 * 6/2004 Espenshade ..... 439/541.5
6,814,612 B1 * 11/2004 Hu et al. ..... 439/541.5
6,976,870 B1 * 12/2005 Li ..... 439/541.5
7,008,762 B2 * 3/2006 Zhang et al. ..... 439/541.5
7,270,570 B1 * 9/2007 Hamner et al. ..... 439/607.04
7,410,391 B2 * 8/2008 Wan et al. ..... 439/607.01
7,473,136 B2 * 1/2009 Hu et al. ..... 439/607.01
2008/0176449 A1 * 7/2008 Hu et al. ..... 439/607
2008/0293301 A1 * 11/2008 Hamner et al. ..... 439/607

* cited by examiner

*Primary Examiner*—Hae Moon Hyeon

(57) ABSTRACT

A connector system includes an upper electrical connector having a housing that defines an open bottomed cavity defining a cavity envelope and that defines a mating interface for a mating connector. The upper electrical connector further has contacts mounted to the housing and extending along the mating interface. The connector system includes a first lower electrical connector mountable to a circuit board that has a first outer envelope adapted for fitting in the cavity envelope, and a second lower electrical connector mountable to a circuit board that has a second outer envelope adapted for fitting in the cavity envelope. The upper electrical connector is separately mountable to the circuit board over each of the first lower electrical connector and the second lower electrical connector. Optionally, the upper electrical connector may be mountable over only one of the first lower electrical connector and the second lower electrical connector at a time.

20 Claims, 7 Drawing Sheets

CONNECTOR SYSTEM HAVING AN ELEVATED UPPER ELECTRICAL CONNECTOR

BACKGROUND OF THE INVENTION

The subject matter relates generally to connector systems and, more particularly, to elevated and/or stackable electrical connectors.

There is an increasing demand for digital content in today's society in both the home and the workplace, due at least in part to the proliferation of electronic devices having digital audio/video sources such as set-top boxes, HD DVD disc players, Blu-ray Disc players, personal computers, video game consoles, or AV receivers. Such devices typically include internal connectors at input/output ports such as, for example, High-Definition Multimedia Interface (HDMI) connectors, Serial Advanced Technology Attachment (SATA) and External SATA or eSATA connectors, IEEE 1394 connectors and Universal Serial Bus (USB) connectors. HDMI connects digital audio/video sources to a compatible digital audio device and/or video monitor such as a digital television (DTV). SATA and eSATA define standards primarily for disk drives, or more generally data storage solutions, for personal computers. The IEEE 1394 and USB are both serial bus interfaces for high speed communication. The connectors are typically mounted at the edge of circuit boards to facilitate access of cable mounted external connectors to the internal circuits of the host devices.

The proliferation of sending, receiving and storing digitally formatted data has led to an increased need for connectors that interconnect the host device with external devices. Additionally, the host devices using such connectors tend to need different types of connectors to allow for interconnection with different types of external devices and/or to allow for integration into an existing system of the end user. Some devices, such as set top boxes, game box converters, etc. may contain multiple types of connectors, such as HDMI, eSATA, IEEE 1394, and USB ports. HDMI connectors, eSATA connectors, IEEE 1394 connectors and/or USB connectors are typically mounted at the edge of circuit boards to facilitate access of cable mounted external connectors to the internal circuits of the host devices. Typically, component area on the circuit boards is limited due to the connectors and other board mounted devices and components, such as resistors, diodes or other components. As a result, it is desirable to conserve space on the circuit boards. Conserving component area on the circuit boards is challenging.

BRIEF DESCRIPTION OF THE INVENTION

In one embodiment, a connector system is provided including an upper electrical connector having a housing that defines an open bottomed cavity defining a cavity envelope and that defines a mating interface for a mating connector. The upper electrical connector further has contacts mounted to the housing and extending along the mating interface. The connector system includes a first lower electrical connector mountable to a circuit board that has a first outer envelope adapted for fitting in the cavity envelope, and a second lower electrical connector mountable to a circuit board that has a second outer envelope adapted for fitting in the cavity envelope. The upper electrical connector is separately mountable to the circuit board over each of the first lower electrical connector and the second lower electrical connector. Optionally, the upper electrical connector may be mountable over only one of the first lower electrical connector and the second lower electrical connector at a time.

Optionally, the housing may include a mounting face that is mounted to the circuit board and a cavity that extends along the mounting face. The housing may include a body and at least one leg extending downward from the body, wherein the leg extends along opposite sides of the cavity and position the body generally above the cavity. Optionally, the housing may include a tongue having a top and a bottom wherein the contacts extend along at least one of the top and the bottom of the tongue. The upper electrical connector may include an organizer located within the housing along a mounting face of the housing, wherein the organizer includes alignment features for aligning the organizer with the circuit board, and the organizer includes apertures arranged in a pattern that receive and position the contacts for attachment to the circuit board. Optionally, the mating interface may be one of HDMI compliant, USB compliant, eSATA compliant, or IEEE compliant where the first lower electrical connector is one of HDMI compliant, USB compliant, eSATA compliant or IEEE compliant, and the second lower electrical connector is one of HDMI compliant, USB compliant, eSATA compliant or IEEE compliant.

In another embodiment, an electrical connector is provided for stacking above a board mounted component. The electrical connector includes a housing having an upper contact area and a lower cavity below the upper contact area, wherein the lower cavity is sized to house the board mounted component therein. The housing is configured to be mounted to a circuit board such that the board mounted component is received within the lower cavity. The electrical connector also includes contacts having mating ends and contact tails, wherein the mating ends are presented in the upper contact area for mating with a mating connector, and the contact tails are mated to the circuit board. An upper shield is mounted to the housing. The upper shield has a shroud surrounding the upper contact area and defining a receptacle for receiving the mating connector.

Optionally, the housing may include a ledge and a slot extending from the ledge, wherein the shroud of the upper shield rests upon the ledge and a protrusion extending from the shroud is received within the slot to key and stabilize the shield on the housing. The electrical connector may also include a lower shield at least partially surrounding the lower cavity. Optionally, the upper shield may include a rear panel folded to engage the lower shield to provide a common ground for the upper and lower shields. The housing may include a body and at least one leg extending downward from the body, wherein the leg extends along opposite sides of the lower cavity and position the body generally above the board mounted component, and wherein the lower shield extends along portions of the leg. Optionally, the lower shield may extend between the legs.

In a further embodiment, an electrical connector is provided for stacking above a second electrical connector. The electrical connector includes a housing having a body and at least one leg extending downward from the body. The housing defines a rear chamber and a lower cavity defined by the body and the at least one leg. The housing is configured to be mounted to a circuit board separate from and above a second electrical connector that is mounted to the circuit board and at least partially positioned within the lower cavity. An upper shield is mounted to the housing, wherein the upper shield has a shroud positioned on the body and defining a receptacle for receiving a mating connector. The upper shield has a rear panel at least partially surrounding the rear chamber. Contacts are supported by the housing and have mating ends and contact tails. The mating ends are presented in the receptacle for mating with the mating connector, and the contact tails extend through the rear chamber and are mated to the circuit board.

DETAILED DESCRIPTION OF THE INVENTION

Figure 1:
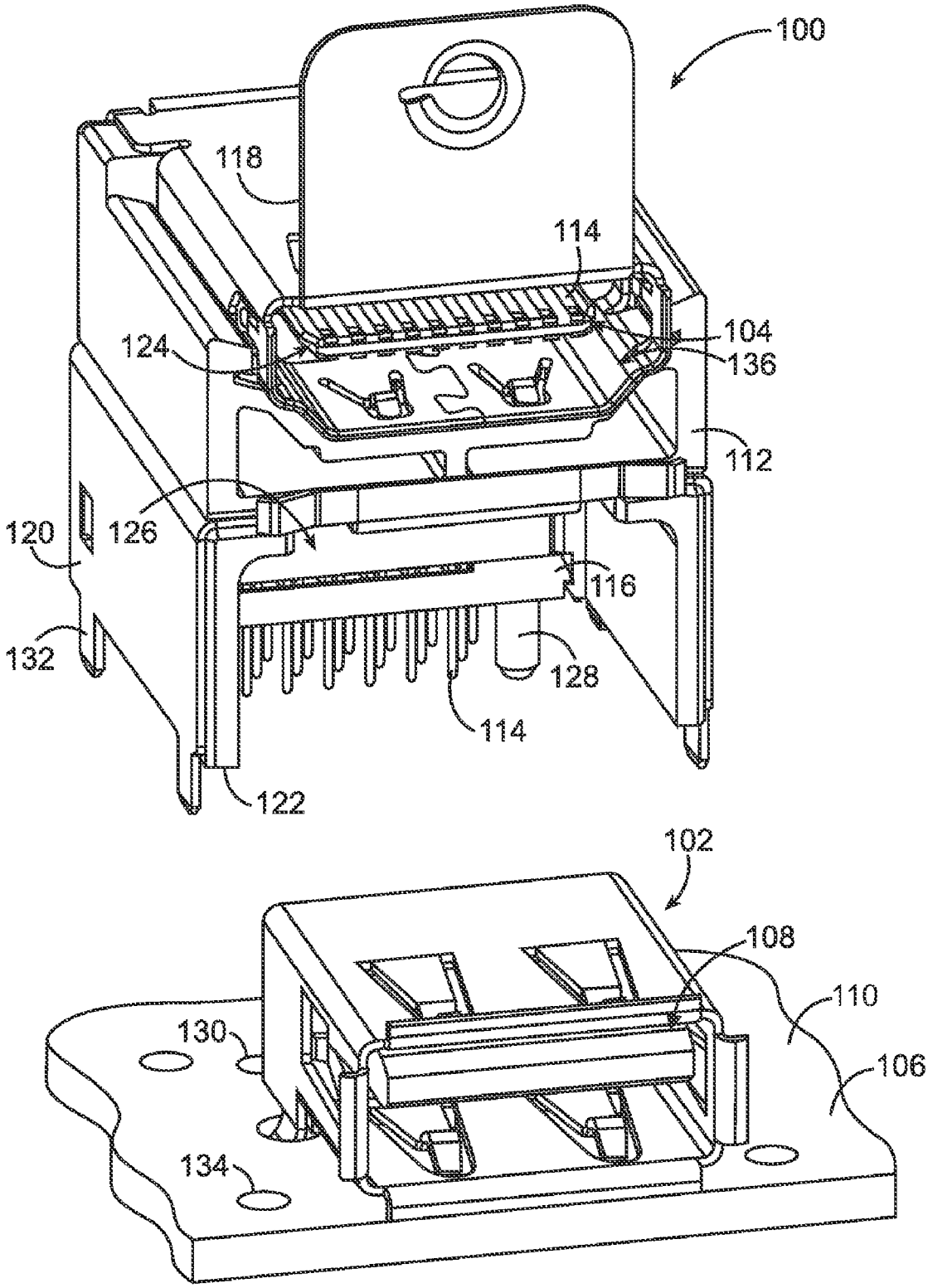
FIG. 1 is a front perspective view of an exemplary electrical connector stacked above another electrical connector.

FIG. 1 is a front perspective view of an exemplary electrical connector 100 elevated and/or stacked above a second electrical connector 102. The electrical connector 100 represents an upper electrical connector that defines a High-Definition Multimedia Interface (HDMI) connector having a mating interface 104 that is HDMI compliant. The second electrical connector 102 represents a lower electrical connector positioned generally vertically below the upper electrical connector. In one application, the electrical connector 100 and the second electrical connector 102 may be used in an electronic device (not shown) having a digital audio and/or video source, such as a set-top box, HD DVD disc player, Blu-ray Disc player, personal computer, video game console, or AV receiver. The electrical connector 100 and the second electrical connector 102 are separately mounted to a circuit board 106. For example, the second electrical connector 102 may be electrically and mechanically coupled to the circuit board 106, and then the electrical connector 100 may be mounted to the circuit board 106 above the second electrical connector 102.

Figure 2:
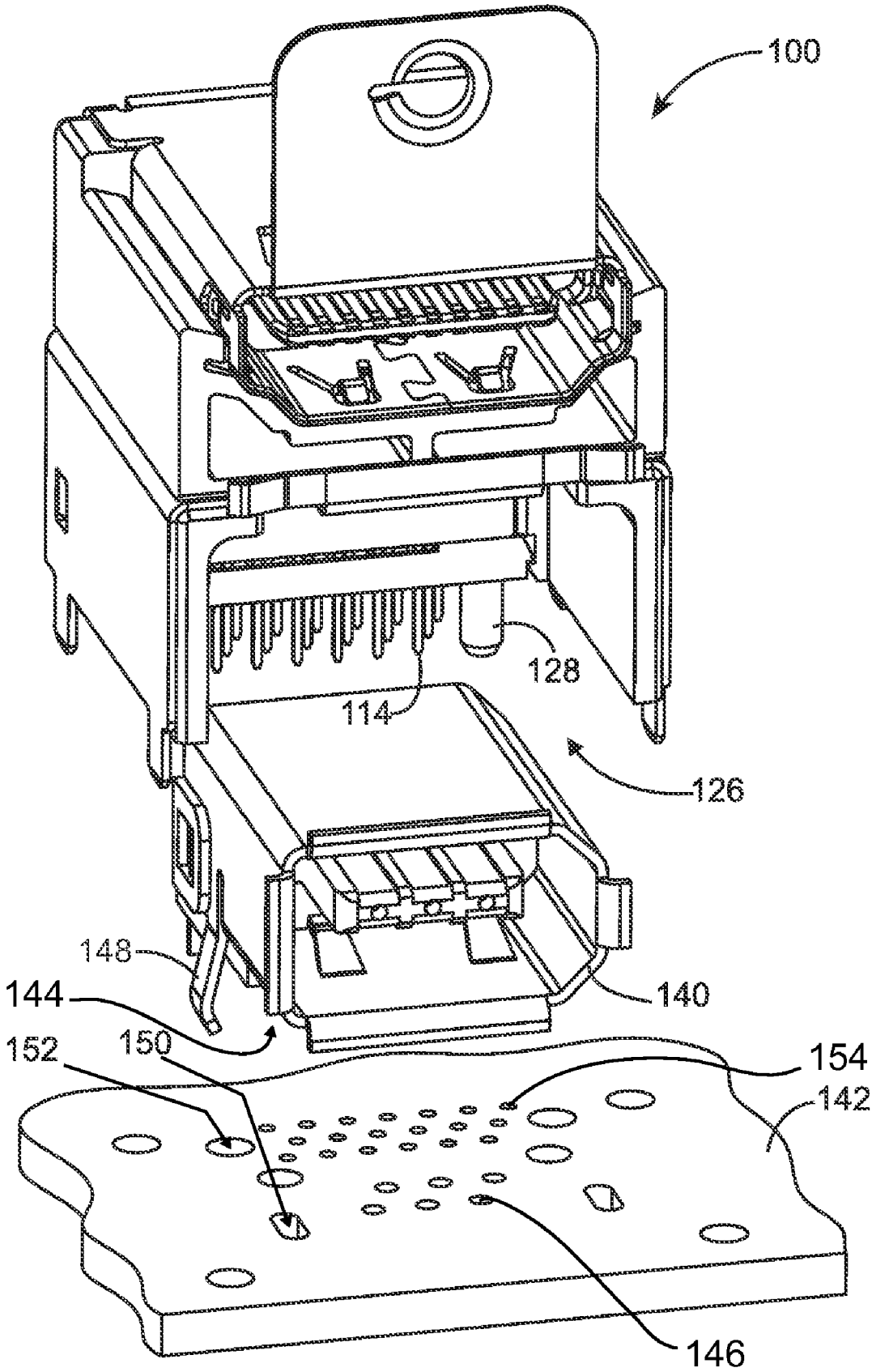
FIG. 2 is a front perspective view of the electrical connector stacked above a different electrical connector.

In the illustrated embodiment, the second electrical connector 102 is a universal serial bus (USB) connector having a mating interface 108 that is USB compliant. The USB connector has dimensions that are typical for USB connectors in terms of height from a top 110 of the circuit board 106, width across the mating interface 108 and depth from the mating interface 108. The width, height and depth define an outer envelope for the second electrical connector 102. The envelope is sized to at least partially fit within the electrical connector 100 when the electrical connector 100 is stacked above the second electrical connector 102. While a USB connector is illustrated in FIG. 1, the second electrical connector 102 may be a different type of connector, such as an IEEE connector (e.g. an IEEE 1394 connector), an eSATA connector, an HDMI connector, or another type of input and/or output connector, such as an audio and/or video connector. In an exemplary embodiment, the electrical connector 100 is sized and shaped to be mounted over different types of connectors, such that the electrical connector 100 may fit over, for example, a USB connector, an IEEE connector, an eSATA connector or an HDMI connector, depending on the particular application or system used by the end-user. For example, as described further below, FIG. 2 illustrates the electrical connector 100 mounted over an IEEE connector rather than the USB connector illustrated in FIG. 1. In other alternative embodiments, rather than one of the electrical connectors listed above, the electrical connector 100 may be used to elevate the mating interface 104 above another component or device rather than an electrical connector, such as board mounted devices or components. The board mounted devices or components may be at least partially positioned below the electrical connector 100, however, the board mounted devices or components may be positioned generally forward of the electrical connector 100 and nothing may be positioned below the electrical connector 100. The elevated nature of the electrical connector 100 is used to allow the user to access the electrical connector 100.

The electrical connector 100 includes a housing 112, a plurality of contacts 114, an organizer 116, an upper shield 118 and a lower shield 120. The housing 112 includes a mounting face 122 that is mounted to the circuit board 106. An upper contact area 124 is defined by the housing 112 at the mating interface 104. The contacts 114 are presented in the upper contact area 124 for mating engagement with mating contacts (not shown) of a mating connector (not shown). The housing 112 includes a lower cavity 126 generally below the upper contact area 124. The cavity 126 is open bottomed and is provided along the mounting face 122. The open bottom of the cavity 126 receives the second electrical connector 102 when the electrical connector 100 is mounted to the circuit board 106. The cavity 126 is sized and shaped such that the electrical connector 100 may be mounted above the second electrical connector 102. The cavity 126 houses at least a portion of the second electrical connector 102. Alternatively, rather than mounting above another component or the second electrical connector 102, the cavity 126 may be empty and the electrical connector 100 may be elevated above the circuit board 106 to elevate the electrical connector 100, such as when another component is in front of the electrical connector 100.

The organizer 116 is coupled to the housing 112 and supports the contacts 114. Optionally, the organizer 116 may be mounted along the mounting face 122. The organizer 116 includes alignment features 128, such as posts, that are received in alignment holes 130 in the circuit board 106. The alignment features 128 and the alignment holes 130 align the organizer 116 with the circuit board 106 during mating of the electrical connector 100 with the circuit board 106.

The lower shield 120 at least partially surrounds the cavity 126. The lower shield 120 may shield the second electrical connector 102 from the electrical connector 100 and/or from other electrical components or devices on or around the circuit board 106. For example, the lower shield 120 may shield the second electrical connector 102 from electromagnetic interference. The lower shield 120 includes posts 132 that are received in holes 134 in the circuit board 106. The posts 132 electrically and/or mechanically couple the lower shield 120 to the circuit board 106.

The upper shield 118 is mounted to the housing 112. In an exemplary embodiment, the upper shield 118 defines a receptacle 136, which forms part of the mating interface 104. The receptacle 136 generally surrounds the upper contact area 124 and the contacts 114. The receptacle 136 is sized and shaped to receive the mating connector. In the illustrated embodiment, the receptacle 136 is dimensioned to be HDMI compliant to receive an HDMI connector.

FIG. 2 is a front perspective view of the electrical connector 100 stacked above a different electrical connector, represented in FIG. 2 by an IEEE connector 140. The IEEE connector 140 replaces the USB connector shown in FIG. 1. The electrical connector 100 is configured to receive the IEEE connector 140 in substantially the same manner as the electrical connector 100 received the USB connector. While the IEEE connector 140 is illustrated within the cavity 126, the IEEE connector 140 and the electrical connector 100 are separately mountable to a circuit board 142. For example, contacts 144 of the IEEE connector 140 are mounted to through holes 146 in the circuit board 142. Posts 148 extending from the IEEE connector 140 are also mounted to holes 150 in the circuit board 142 to securely hold the IEEE connector 140 to the circuit board 142, such as during a soldering process. The contact pattern of the IEEE contacts 144 is different than the contact pattern of the USB connector, which also means that the pattern of the through holes 146 is different than the pattern for the USB connector application. The IEEE connector 140 has a height, width and depth that defines an outer envelope that is different than the envelope defined by the USB connector. Both envelopes fit within the cavity 126, however, the depth may be such that at least a portion of the IEEE connector 140 extends outward from the front of the cavity 126.

Once the IEEE connector 140 is mounted to the circuit board 142, the electrical connector 100 may then be mounted above the IEEE connector 140. For example, the alignment features 128 of the organizer 116 (shown in FIG. 1) may be received in holes 152 in the circuit board 142 and the contacts 114 may be received in through holes 154 in the circuit board 142.

Figure 3:
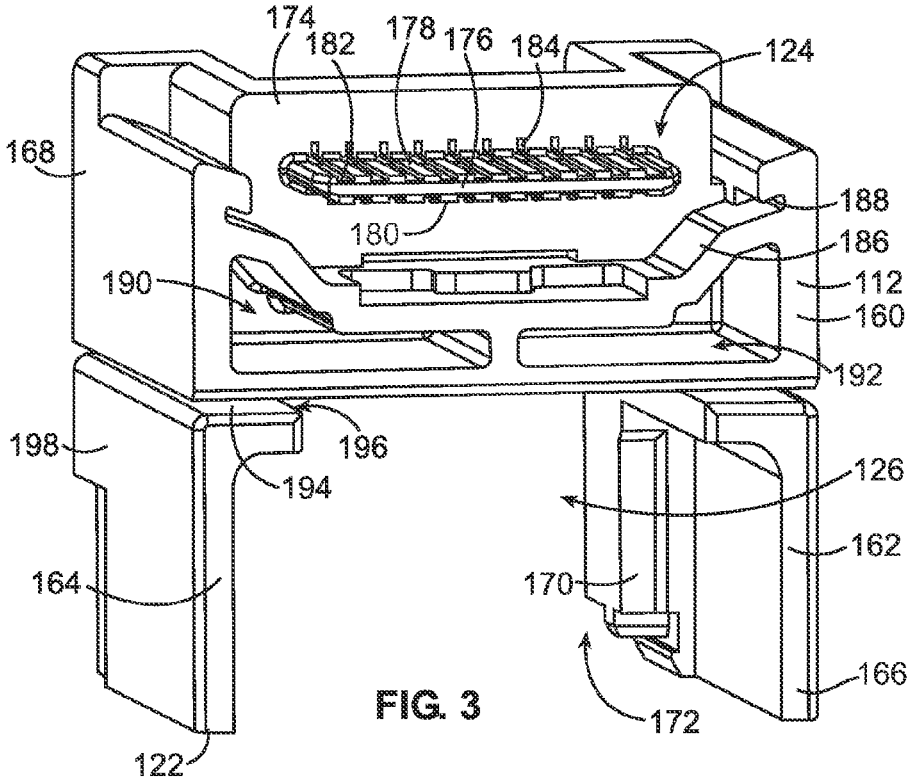
FIG. 3 is a front perspective view of a housing of the electrical connector shown in FIG. 1.

FIG. 3 is a front perspective view of the housing 112 of the electrical connector 100 (shown in FIG. 1). The housing 112 is used as a carrier for the remaining components of the electrical connector 100. The housing 112 is fabricated from a dielectric material and includes a body 160 and a pair of legs 162, 164 extending downward from the body 160 to the mounting face 122.

The lower cavity 126 is generally defined by the legs 162, 164 on the sides of the cavity 126 and the body 160 on the top of the cavity 126. A bottom of the cavity 126 is open and coincident with the mounting face 122. The housing 112 also includes a front face 166 and a rearward end 168. The lower cavity 126 is generally open along the front face 166 to provide access to the second electrical connector 102 (shown in FIG. 1) and/or to provide an opening for the second electrical connector 102 to extend out of the cavity 126. A rear cavity wall 170 of the housing 112 defines a rear portion of the cavity 126. Optionally, the rear cavity wall 170 may include an opening 172 separating the legs 162, 164. Alternatively, the rear cavity wall 170 may connect the legs 162, 164.

The body 160 includes the upper contact area 124. In an exemplary embodiment, the body 160 includes a base wall 174 and a tongue 176 extending forward from the base wall 174. The base wall 174 extends generally vertically. Optionally, the base wall 174 may be substantially centrally positioned within the body 160. The tongue 176 includes a top 178 and a bottom 180. Slots 182 are formed in the top 178 and the bottom 180. The slots 182 receive the contacts 114 (shown in FIG. 1) as described in further detail below. Alternatively, slots 182 may be formed in only one of the top 178 and the bottom 180. In other alternative embodiments, the top 178 and bottom 180 may be generally planar and the contacts 114 may be placed on the planar surfaces of the top and/or bottom 178, 180. Additionally, apertures 184 extend through the base wall 174 and are associated with each slot 182. The contacts 114 extend through the apertures 184 and into the slots 182.

The body 160 includes a ledge 186 extending forward from the base wall 174 generally vertically below, and spaced apart from, the tongue 176. The ledge 186 is configured to support the upper shield 118 (shown in FIG. 1) once assembled, as will be described in further detail below. Optionally, slots 188 may extend into the housing 112 from the ledge 186 to receive protrusions of the upper shield 118 to key and/or stabilize the upper shield 118 on the housing 112. The housing 112 is generally open above the ledge 186 and the tongue 176. In an alternative embodiment, the housing 112 may circumferentially surround the tongue 176 and define an opening around the tongue 176 such that the ledge 186 forms a lower portion of the opening.

A spacing section 190 is provided in a lower portion of the body 160. The spacing section 190 separates the upper contact area 124 and the cavity 126. Optionally, the spacing section 190 may include openings 192 from the front face 166 that extend to the base wall 174.

In an exemplary embodiment, the legs 162, 164 may be connected to the body 160 by stems 194. Grooves 196 may be provided between the body 160 and the legs 162, 164 that extend at least partially around the stems 194. The grooves 196 provide a channel inward from sides 198 of the housing 112. The grooves 196 provide a channel inward from the front face 166 of the housing 112. The grooves 196 provide a channel inward from the surfaces of the legs 162, 164. As described in further detail below, the lower shield 120 (shown in FIG. 1) is received within the channels formed by the grooves 196.

Figure 4:
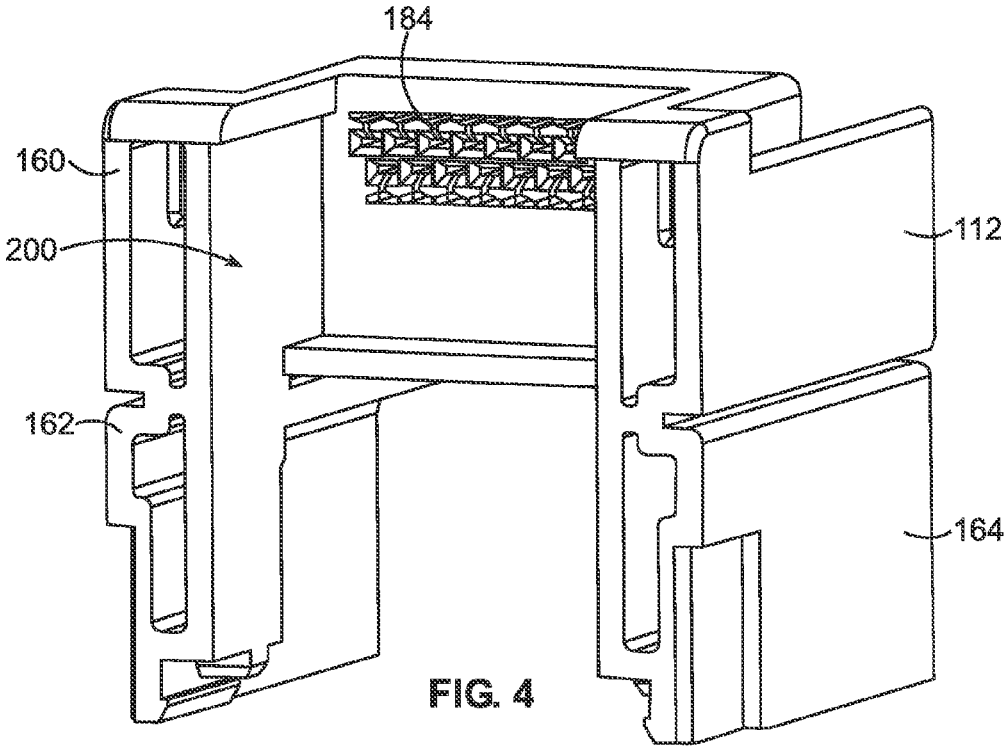
FIG. 4 is a rear perspective view of the housing shown in FIG. 3.

FIG. 4 is a rear perspective view of the housing 112. A rear chamber 200 is illustrated in FIG. 4. The rear chamber 200 is formed in the body 160 and also extends between the legs 162, 164. As described in further detail below, the rear chamber 200 is configured to receive the contacts 114 (shown in FIG. 1) and provide a space for the contacts 114 to extend between the circuit board 106 (shown in FIG. 1) and the apertures 184 in the body 160. The rear chamber 200 may provide a space for the contacts 114 to transition from generally upwardly extending to generally forwardly extending, such that the contacts 114 may be presented at the upper contact area 124 (shown in FIG. 3).

Figure 5:
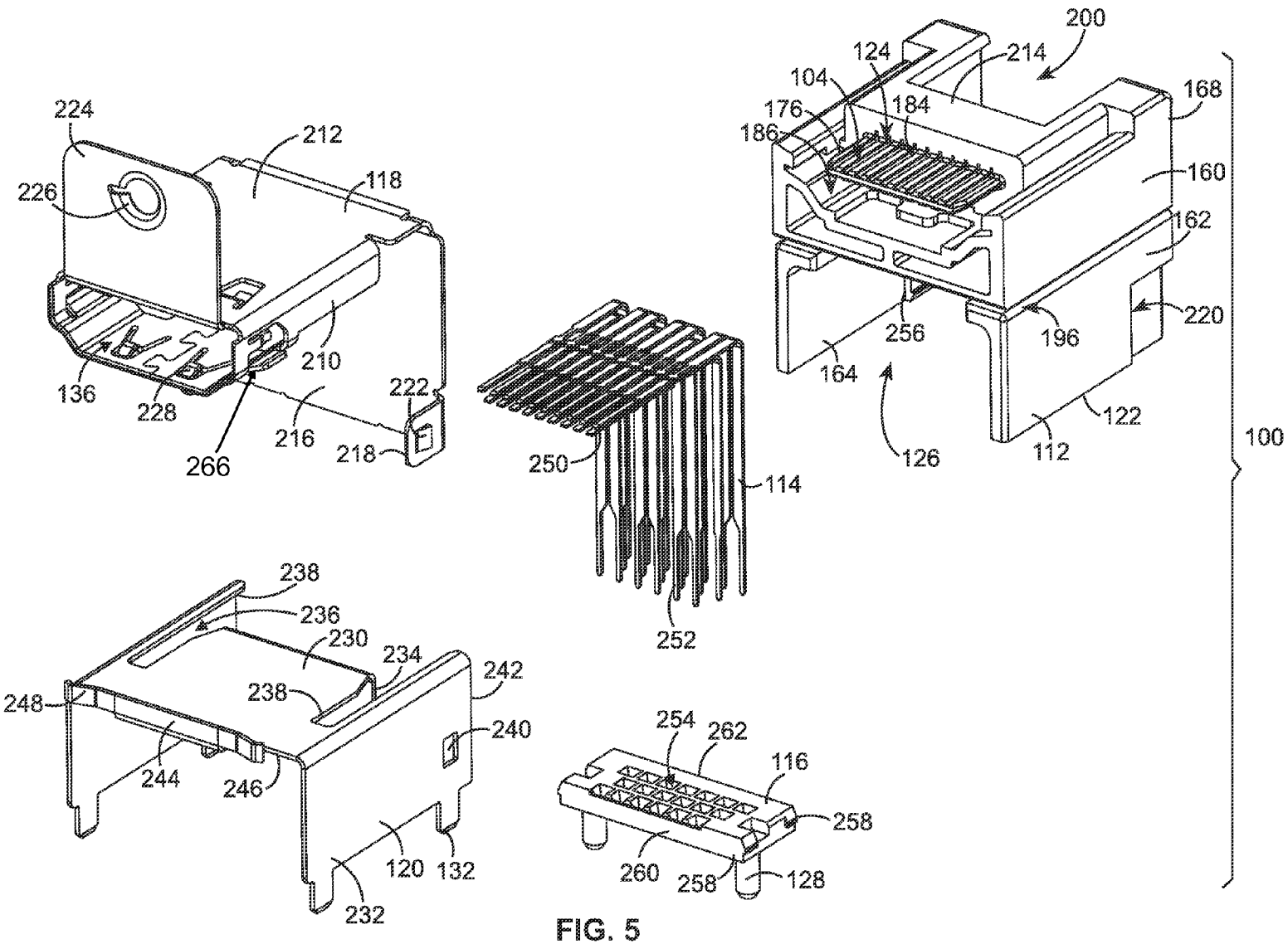
FIG. 5 is an exploded view of the electrical connector.

FIG. 5 is an exploded view of the electrical connector 100, illustrating the housing 112, contacts 114, organizer 116, upper shield 118 and lower shield 120. The housing 112 is used as a carrier for the contacts 114, organizer 116, upper shield 118 and lower shield 120. The housing 112 provides the lower cavity 126 for stacking the mating interface 104 of the electrical connector 100 above the second electrical connector 102 (shown in FIG. 1), thus reducing the amount of real estate, or surface area, needed to connect both the electrical connector 100 and the second electrical connector 102 to the circuit board 106 (shown in FIG. 1) in a stacked configuration as opposed to a side-by-side configuration.

The upper shield 118 includes a shroud 210 that forms the receptacle 136 and covers an upper surface 214 of the housing 112 when the upper shield 118 is installed on the housing 112. In an exemplary embodiment, the shroud 210 rests upon at least a portion of the ledge 186. The shroud 210 includes a top panel 212. The upper shield 118 also includes a rear panel 216 that may be folded over, or otherwise formed to substantially cover, the rearward end 168 of the housing 112. Tabs 218 extend from the rear panel 216 and are received in recesses 220 in the housing 112. The tabs 218 include latches 222 that extend out of plane with respect to the tabs 218. In an exemplary embodiment, the upper shield 118 includes a mounting tab 224 extending from the top panel 212 of the shroud 210 to mount the electrical connector 100 to a panel (not shown) of the electronic device in which the electrical connector 100 is used. The mounting tab 224 includes an attachment hole 226 formed with a stamped thread for convenient screw attachment to the panel. Optionally, the shroud 210 may include retention tabs 228 that extend along or partially into the receptacle 136 to engage and/or hold the mating connector (not shown).

The lower shield 120 includes a top panel 230, side panels 232 that extend downwardly from the top panel 230, and a rear panel 234 that also extends downwardly from the top panel 230. The top panel 230 includes a pair of channels 236 proximate the side panels 232 that extend forward from the rear portion of the lower shield 120. As described in further detail below, the stems 194 (shown in FIG. 3) of the housing 112 are received in the channels 236 when the lower shield 120 is mounted to the housing 112. For example, a lip 238 of the lower shield 120 is received in the grooves 196 separating the body 160 from the legs 162, 164 of the housing 112. The posts 132 are provided to mount the lower shield 120 to the circuit board 106 (shown in FIG. 1). In one embodiment, the posts 132 electrically engage a ground circuit in the circuit board 106. Windows 240 are formed at a rearward end 242 of the side panels 232. The windows 240 receive the latches 222 of the upper shield 118 to secure the tabs 218 of the upper shield 118 to the lower shield 120 and thereby provide a common ground between the upper shield 118 and the lower shield 120. In an exemplary embodiment, the lower shield 120 includes a grounding web 244 that extends from a front end 246 of the lower shield 120. The grounding web 244 includes fingers 248 that engage the panel (not shown) to establish a grounding connection. In some embodiments, the upper shield 118 and the lower shield 120 may be formed as a single unit.

A group of the contacts 114 are held by the housing 112. Each of the contacts 114 includes a mating end 250 and a contact tail 252. The mating ends 250 are presented in the upper contact area 124 and are positioned along the tongue 176 for mating with a mating connector (not shown). For example, the contacts 114 may be loaded into the apertures 184 of the housing 112 through the rear chamber 200. The contact tails 252 extend through the rear chamber 200 to the contact organizer 116. In an exemplary embodiment, when assembled, the rear panel 216 of the upper shield 118 extends along a rear portion of the rear chamber 200 and the rear panel 234 of the lower shield 120 extends along a front portion of the rear chamber 200. As such, the contacts 114 are at least partially shielded from the second electrical connector 102 by the lower shield 120 and the contacts 114 are at least partially shielded from external components by the upper shield 118. In an exemplary embodiment, the contacts 114 are arranged in two rows, one on each side of the tongue 176. The contact tails 252 are arranged in three rows and are configured to be coupled to the circuit board 106 (shown in FIG. 1). Optionally, some of the contacts 114 are signal contacts carrying signals and some of the contacts are ground contacts that are grounded to a ground circuit of the circuit board 106.

The organizer 116 is received in the housing 112 and may be positioned along the mounting face 122 of the housing 112. The organizer 116 is positioned generally below the rear chamber 200. The organizer 116 includes a plurality of apertures 254 that receive contact tails 252 of the contacts 114. The contact tails 252 extend through the apertures 254 to electrically connect with the circuit board 106. The apertures 254 are arranged in a pattern corresponding to a pattern of holes in the circuit board 106 for mating with the contacts 114. The organizer 116 has alignment features 128 that align the organizer 116 with the circuit board 106, which also align the apertures 254 with the holes in the circuit board 106. The organizer 116 has keying slots that key the organizer 116 to the housing 112. In an exemplary embodiment, the housing 112 includes latches 256 that engage notches 258 in the organizer 116 to retain the organizer 116 within the housing 112. The organizer 116 includes a front end 260 and a rear end 262. When assembled, the front end 260 is substantially aligned below the rear panel 234 of the lower shield 120 and the rear end 262 is substantially aligned below the rear panel 216 of the upper shield 118. Alternatively, the rear panels 234, 216 may extend along the front and rear ends 260, 262 of the organizer 116.

Figure 6:
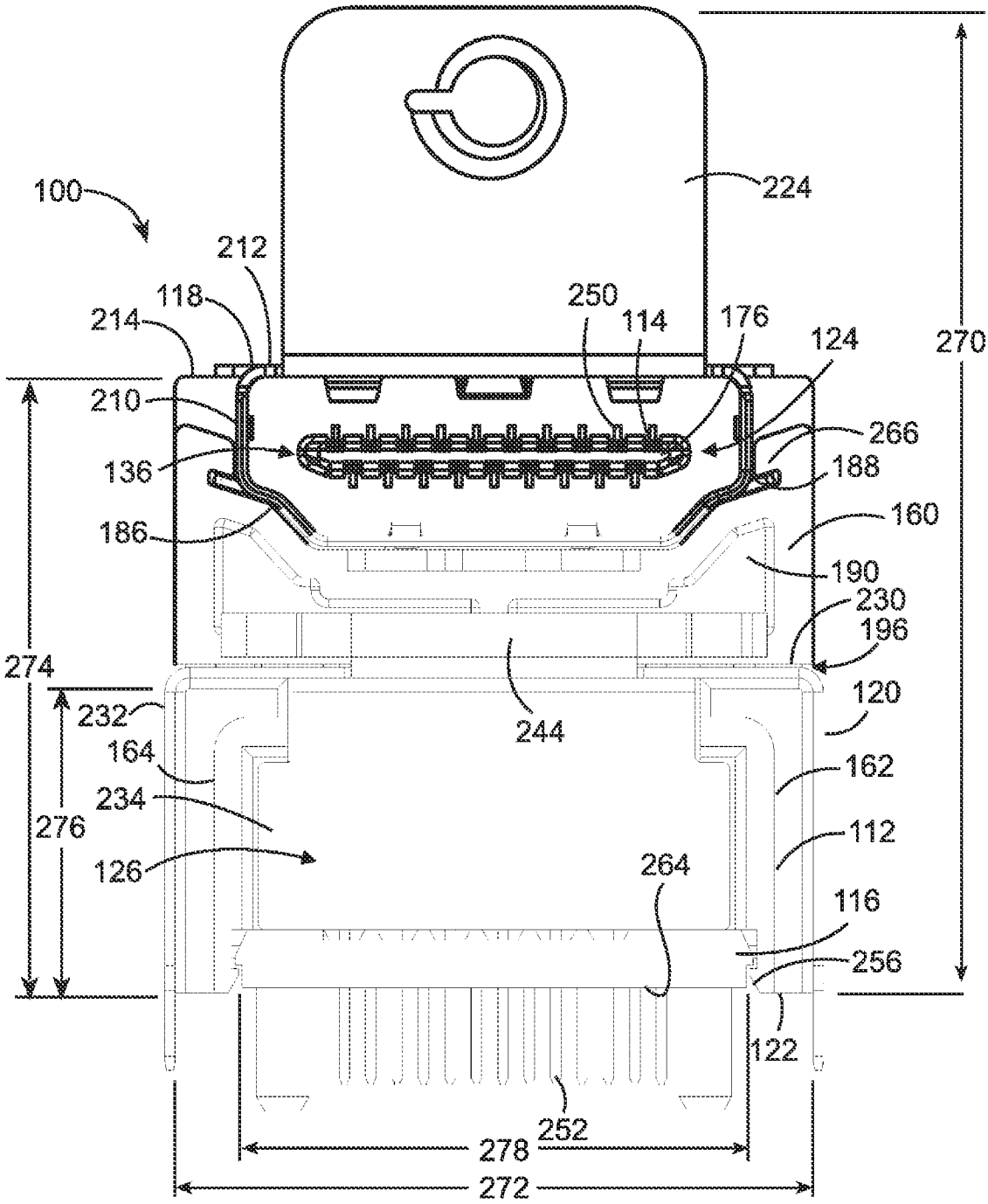
FIG. 6 is a front view of the electrical connector.

FIG. 6 is a front view of the electrical connector 100 in an assembled state. The organizer 116 is latched into the housing 112 by the latches 256. A mounting face 264 of the organizer 116 is substantially flush with the mounting face 122 of the housing 112. The organizer 116 supports the contact tails 252 of the contacts 114.

The lower shield 120 is mounted to the housing 112. The top panel 230 is positioned in the groove 196 between the body 160 and the legs 162, 164. The side panels 232 are positioned along the exterior of the legs 162, 164. The rear panel 234 is positioned within the lower cavity 126, near the rear of the cavity 126. In an exemplary embodiment, the rear panel 234 is positioned between the cavity 126 and the rear chamber 200 (shown in FIG. 4). The grounding web 244 extends upward, in front of the spacing section 190 of the housing 112.

The upper shield 118 is mounted to the housing 112. The shroud 210 rests upon the ledge 186 and forms the receptacle 136. The mating ends 250 of the contacts 114 are presented on the tongue 176 in the upper contact area 124 for mating with the mating connector (not shown) received in the receptacle 136. In an exemplary embodiment, the upper shield 118 includes protrusions 266 on the sides of the shroud 210 that extend into the slots 188 in the housing 112. The protrusions 266 key and/or stabilize the upper shield 118 on the housing 112. The top panel 212 of the shroud 210 covers the upper surface 214 of the housing 112. The mounting tab 224 extends upward from the top panel 212. In an exemplary embodiment, the mounting tab 224 is substantially coplanar with the grounding web 244 of the lower shield 120.

In an exemplary embodiment, the electrical connector 100 is configured to be stacked above the second electrical connector 102 (shown in FIG. 1). For example, the electrical connector 100 may be mounted to the circuit board 106 (shown in FIG. 1) such that the second electrical connector 102 is positioned within the lower cavity 126. The receptacle 136 of the electrical connector 100 is thus positioned generally vertically above the second electrical connector 102. The electrical connector has a height 270 and a width 272. The housing 112 has a height 274.

The lower cavity 126 is sized to receive the second electrical connector 102 therein. The cavity 126 has a height 276 and a width 278 that define an envelope configured to accommodate the second electrical connector 102. Optionally, the envelope may accommodate more than one type of second electrical connector 102. For example, the envelope may accommodate the USB type of connector illustrated in FIG. 1 and the IEEE connector 140 shown in FIG. 2. The envelope may accommodate other types of connectors as well, such as an HDMI type of connector, or another type of input and/or output connector, such as an audio and/or video connector. In an exemplary embodiment, the height 274 of the housing 112 is approximately twice the height 276 of the cavity 126. The width 272 of the housing 112 is slightly wider than the width 278 such that the electrical connector 100 utilizes approximately the same real estate, or surface area, on the circuit board 106 as the second electrical connector 102.

Figure 7:
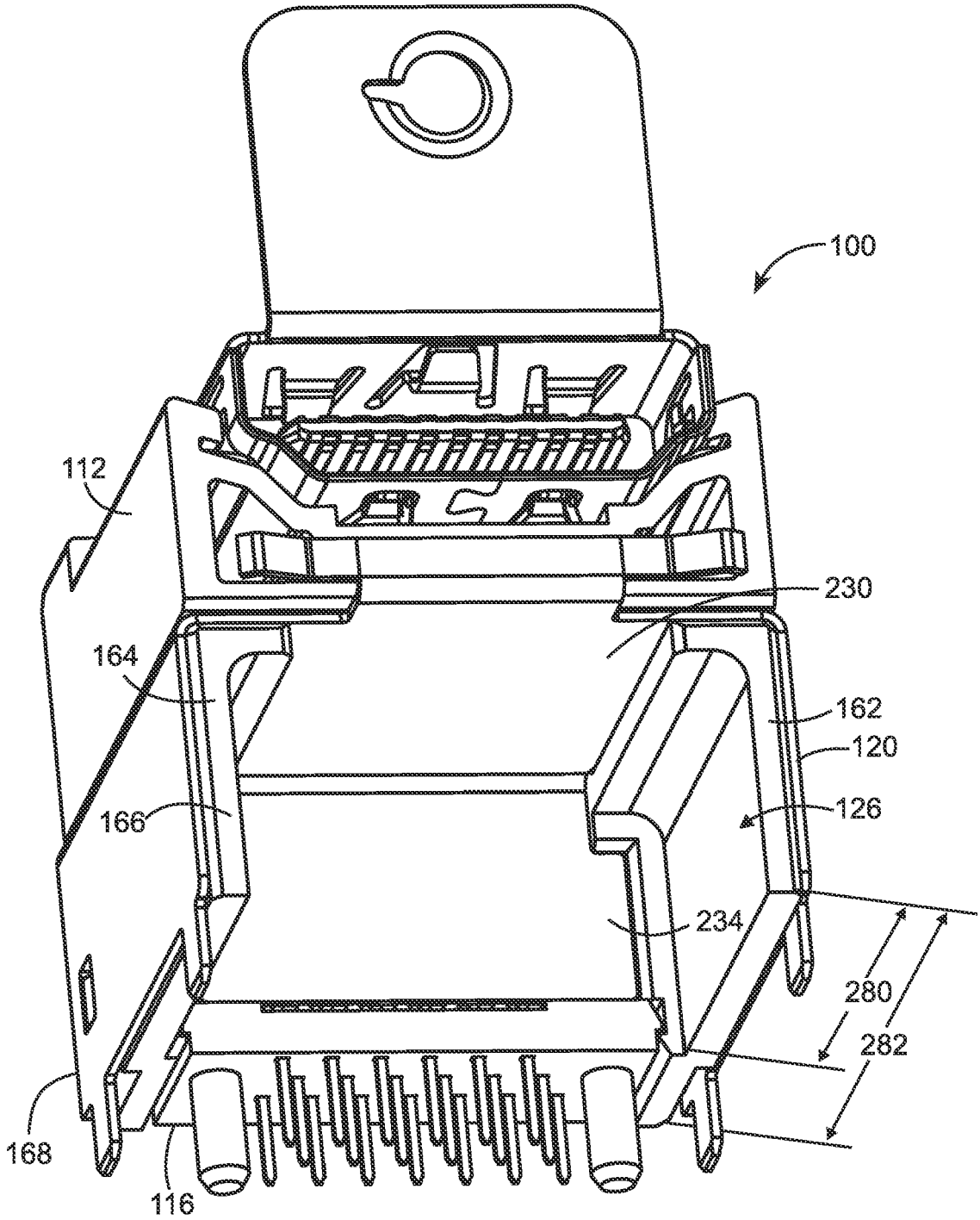
FIG. 7 is a bottom perspective view of the electrical connector.

FIG. 7 is a bottom perspective view of the electrical connector 100. As illustrated in FIG. 7, the lower shield 120 substantially surrounds the lower cavity 126. The top panel 230 extends along the top of the cavity 126 generally between the legs 162, 164. The rear panel 234 is positioned along the rear of the cavity 126 generally between the legs 162, 164. The cavity 126 has a depth 280 that is configured to receive the second electrical connector 102 (shown in FIG. 1). Optionally, the depth 280 may be able to accommodate the second electrical connector 102 such that the mating interface 108 (shown in FIG. 1) is substantially flush with the front face 166 of the housing 112. Alternatively, the second electrical connector 102 may extend at least partially from the front face 166 of the housing 112 either in front of or behind the front of the housing 112. The organizer 116 is positioned rearward of the cavity 126. The housing 112 has a depth 282 between the front face 166 and the rearward end 168. The depth 282 of the housing 112 is slightly deeper than the depth 280 of the cavity 126 such that the electrical connector 100 utilizes approximately the same real estate, or surface area, on the circuit board 106 (shown in FIG. 1) as the second electrical connector 102. In an exemplary embodiment, the depth 282 of the housing 112 is less than twice the depth 280 of the cavity 126.

Figure 8:
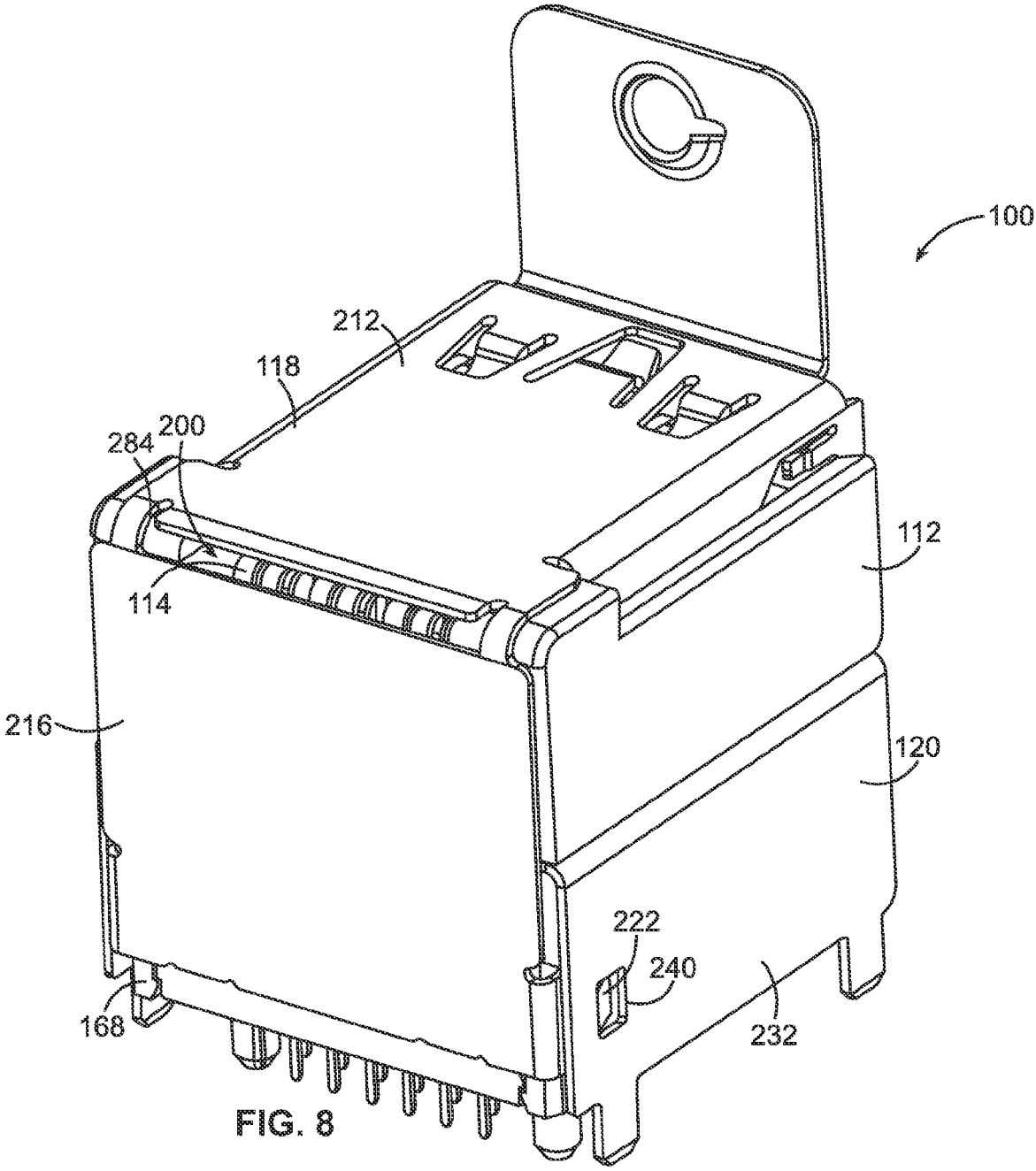
FIG. 8 is a rear perspective view of the electrical connector.

FIG. 8 is a rear perspective view of the electrical connector 100. In an exemplary embodiment, the top panel 212 of the upper shield 118 is connected to the rear panel 216 by connecting tabs 284 that may be folded over to allow the rear panel 216 to extend along the rearward end 168 of the housing 112. The rear panel 216 encloses the rear chamber 200 which houses the contacts 114. The upper shield 118 is electrically coupled to the lower shield 120. For example, the windows 240 in the side panels 232 receive the latches 222 of the upper shield 118 to provide a common ground between the upper shield 118 and the lower shield 120.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Additionally, directional terms such as above, below, vertically, horizontally, downward, upward etc. assume a horizontally oriented substrate or circuit board and mounting of the electrical connector to a top surface of the circuit board such that the housing generally extends upwardly. Such terms are relative and the orientations of the components may be different in alternative embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector for stacking above a separate board mounted component, the electrical connector comprising:

a housing having an upper contact area and an open lower cavity below the upper contact area, the open lower cavity being sized and configured to house the separate board mounted component therein, wherein the housing is configured to be mounted to a circuit board such that the separate board mounted component is received within the open lower cavity during mounting of the housing to the circuit board, wherein the open lower cavity has an open bottom configured to receive the separate board mounted component therethrough during mounting of the housing to the circuit board;

contacts having mating ends and contact tails, the mating ends being presented in the upper contact area for mating with a mating connector, the contact tails being matable to the circuit board; and an upper shield mounted to the housing, the upper shield having a shroud surrounding the upper contact area and defining a receptacle for receiving the mating connector.

2. The electrical connector of claim 1, wherein the housing includes a tongue in the upper contact area, the contacts extend along the tongue, the shroud of the upper shield circumferentially surrounds the tongue and the contacts to form a mating interface for mating with the mating connector.

3. The electrical connector of claim 1, wherein the housing includes a ledge and a slot extending from the ledge, the shroud of the upper shield resting upon the housing proximate to the ledge and a protrusion extending from the shroud is received within the slot to key and stabilize the shield on the housing.

4. The electrical connector of claim 1, further comprising a lower shield at least partially surrounding the open lower cavity such that the lower shield is configured to at least partially surrounds the separate board mounted component.

5. The electrical connector of claim 4, wherein the upper shield includes a rear panel folded to engage the lower shield to provide a common ground for the upper and lower shields.

6. The electrical connector of claim 4, wherein the housing includes a body and at least one leg extending downward from the body, the at least one leg extends along opposite sides of the open lower cavity and positions the body generally above the separate board mounted component, the lower shield extending along portions of the at least one leg.

7. The electrical connector of claim 4, wherein the housing includes a body and a pair of legs extending downward from the body, the legs extend along opposite sides of the open lower cavity and position the body generally above the separate board mounted component, the lower shield extending between the legs.

8. The electrical connector of claim 1, wherein the upper shield includes a mounting tab for attachment to a panel of an electrical device to provide a common ground for the upper shield and the electrical device.

9. The electrical connector of claim 1, wherein the housing includes a mounting face configured to extend along the circuit board, the open bottom of the lower cavity being coplanar with the mounting face.

10. The electrical connector of claim 1, further comprising an organizer coupled to the housing along a mounting face of the housing, the organizer includes alignment features for aligning the organizer with the circuit board, the organizer includes apertures arranged in a pattern that receive and position the contacts for attachment to the circuit board.

11. The electrical connector of claim 1, wherein the open lower cavity has an open front and an open bottom, the housing having a back wall and side walls extending between the back wall, the back wall and the side walls defining the lower cavity, the back wall being positioned between the lower cavity and the contacts.

12. The electrical connector of claim 1, wherein the housing is mounted to the circuit board separate in time from the separate board mounted component such that the separate board mounted component is configured to be positioned within the open lower cavity.

13. An electrical connector for stacking above a second electrical connector, the electrical connector comprising:

a housing having a body and at least one leg extending downward from the body, the housing defines a rear chamber and a lower cavity defined by the body and the at least one leg, wherein the housing is configured to be mounted to a circuit board separate from and above the second electrical connector that is mounted to the circuit board and at least partially positioned within the lower cavity, wherein the lower cavity has an open bottom being configured to receive the second electrical connector therethrough during mounting of the housing to the circuit board;

an upper shield mounted to the housing, the upper shield having a shroud positioned on the body and defining a receptacle for receiving a mating connector, and the upper shield having a rear panel at least partially surrounding the rear chamber; and contacts supported by the housing and having mating ends and contact tails, the mating ends being presented in the receptacle for mating with the mating connector, the contact tails extending through the rear chamber and being matable to the circuit board.

14. The electrical connector of claim 13, wherein the rear panel extends at least partially along the legs.

15. The electrical connector of claim 13, further comprising a lower shield at least partially surrounding the lower cavity, the lower shield extends at least partially along the legs.

16. The electrical connector of claim 13, further comprising a lower shield at least partially surrounding the lower cavity, the lower shield having a rear panel positioned between the rear chamber and the lower cavity.

17. The electrical connector of claim 13, wherein the housing includes a tongue having a top and a bottom, the contacts extend along at least one of the top and the bottom of the tongue.

18. The electrical connector of claim 13, further comprising an organizer coupled to the housing along a mounting face of the housing, the organizer includes alignment features for aligning the organizer with the circuit board, the organizer includes apertures arranged in a pattern that receive and position the contacts for attachment to the circuit board.

19. The electrical connector of claim 13, wherein the housing is mounted to the circuit board separate in time from the second electrical connector such that the second electrical connector is configured to be positioned within the lower cavity.

20. The electrical connector of claim 13, wherein the housing includes a mounting face configured to extend along the circuit board, the open bottom of the lower cavity being coplanar with the mounting face.

* * * * *